United States Patent [19]

Dejana

[11] Patent Number: 4,769,933

[45] Date of Patent: Sep. 13, 1988

[54] SNOWPLOW ASSEMBLY QUICK BLOCK AND PIN DISCONNECT FOR A PAYLOADER

[76] Inventor: Vincent Dejana, 68 Carlton Ave., Port Washington, N.Y. 11050

[21] Appl. No.: 82,301

[22] Filed: Aug. 6, 1987

[51] Int. Cl.[4] ..... E01H 5/04

[52] U.S. Cl. ..... 37/231; 37/117.5; 414/723

[58] Field of Search ..... 37/117.5, 231, 279, 37/103; 414/685, 686, 723; 172/811, 817

[56] References Cited

U.S. PATENT DOCUMENTS

| | | | |
|---|---|---|---|
| 2,307;655 | 1/1943 | Arps | 37/231 |
| 2,577,145 | 12/1951 | Nearing et al. | 37/231 |
| 3,233,350 | 2/1966 | Malzahn et al. | 37/231 |
| 3,388,929 | 6/1968 | Miley | 37/231 |
| 3,605,906 | 9/1971 | Coates | 37/231 |
| 4,096,652 | 6/1978 | Raines et al. | 37/231 |
| 4,295,287 | 10/1981 | Natzue et al. | 37/103 |
| 4,311,428 | 1/1982 | Arnold | 414/723 |
| 4,417,844 | 11/1983 | Pingon | 414/723 |
| 4,625,988 | 12/1986 | Witchey et al. | 37/231 |

*Primary Examiner*—Eugene H. Eickholt
*Attorney, Agent, or Firm*—Michael I. Kroll

[57] ABSTRACT

A snowplow assembly for a payloader that has a bucket is provided and consists of an elongated snowplow blade attached to the bucket via a pair of push arm frame units that are each connected to one of a pair of quick connect block units that are each connected to one of a pair of quick connect pin units. The snowplow blade extends in front of the bucket with an increased surface for fast removal of snow from the ground.

10 Claims, 2 Drawing Sheets

SNOWPLOW ASSEMBLY QUICK BLOCK AND PIN DISCONNECT FOR A PAYLOADER

BACKGROUND OF THE INVENTION

1. Field of the Invention

The instant invention relates generally to snowplows and more specifically it relates to a snowplow asseably for a payloader or the like.

2. Description of the Prior Art

Numerous snowplows have been provided in prior art that are adapted to be attached to various motor vehicles such as sanitation vehicles, tow trucks, etc. to remove snow from roads and railroad tracks. While these units may be suitable for the particular purpose to which they address, they would not be as suitable for the purposes of the present invention as heretofore described.

SUMMARY OF THE INVENTION

A priary object of the present invention is to provide a snowplow assembly for a payloader or the like that will overcome the shortcomings of the prior art devices.

Another object is to provide a snowplow assebly for a payloader or the like that can be quickly attached to and reoved from the bucket of the payloader An additional object is to provide a snowplow assembly for a payloader or the like, that is approxately five ties as large as the bucket of the payloader so as to increase the surface of the blade for faster removal of snow from roads.

A further object is to provide a snowplow assembly for a payloader or the like that is simple and easy to use.

A still further object is to provide a snowplow assembly for a payloader or the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 5 is a partial perspective view of the quick connect block unit and modified quick connect pin unit on a machine push arm of a rubber tire dozer or the like.

DETAILED DESCRIPTION OF THE PREFERRED EMBODIMENTS

Figure 1:
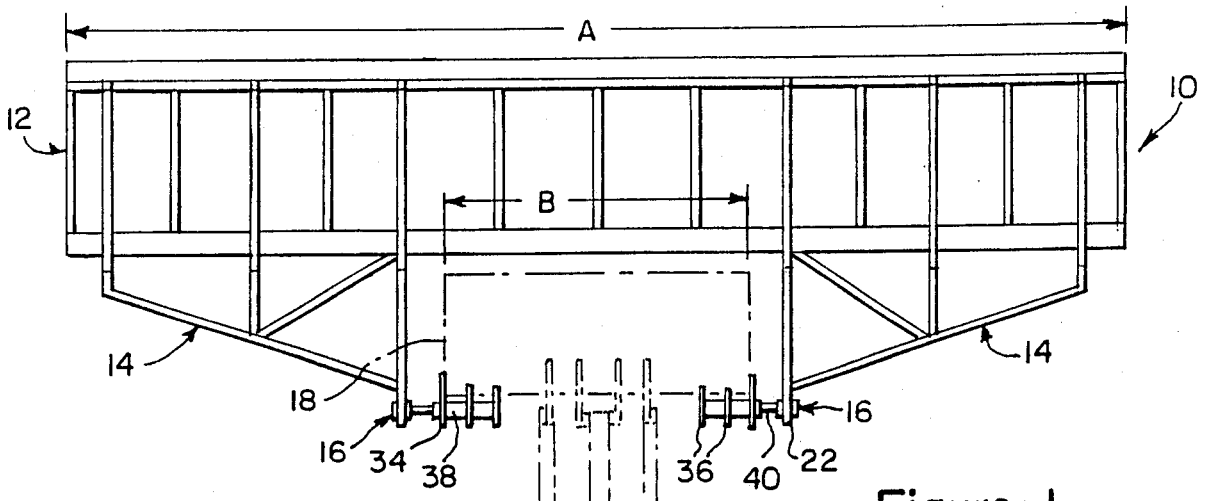
FIG. 1 is a top plan view of the invention attached to the bucket of a payloader.
Figure 2:
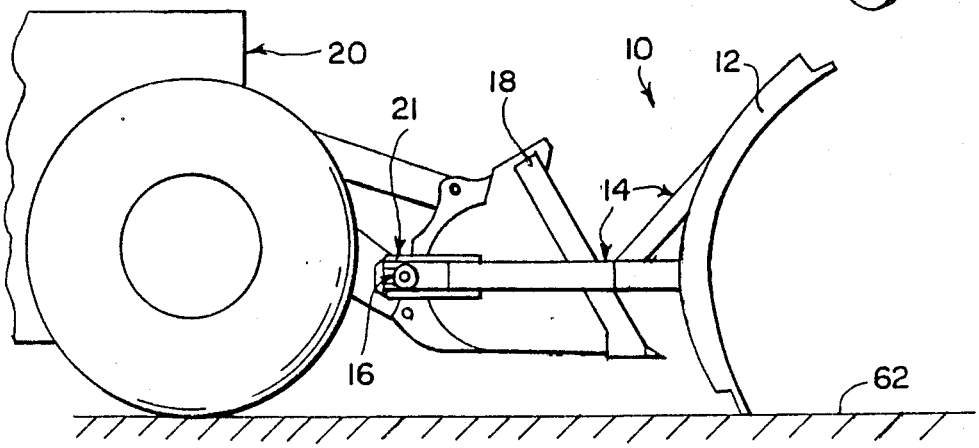
FIG. 2 is a side view thereof with the payloader broken away.

Turning now descriptively to the drawings, in which similar reference characters denote similar elements throughout the several views, FIGS. 1 and 2 illustrate a snowplow assembly 10 for a payloader 20 that has a bucket 18. The snowplow assebly 10 consists of a pair of quick connect pin units 16, a pair of quick connect block units 21, a pair of push arm frame units 14 and an elongated snowplow blade 12.

Each of the pin units 16 is secured to one rearward end of the bucket 18 of the payloader 20, each of the block units 21 is reovably claped onto one of the quick connect pin units 16 and each of the frae units 14 is secured to one of the block units 21. The elongated snowplow blade 12 is affixed to both of the push arm frame units 14 so that the snowplow blade 12 can extend in front of surface "B" of the bucket 18 of the payloader 20 with an increased surface "A" for fast reoval of snow from ground 62.

Figure 4:
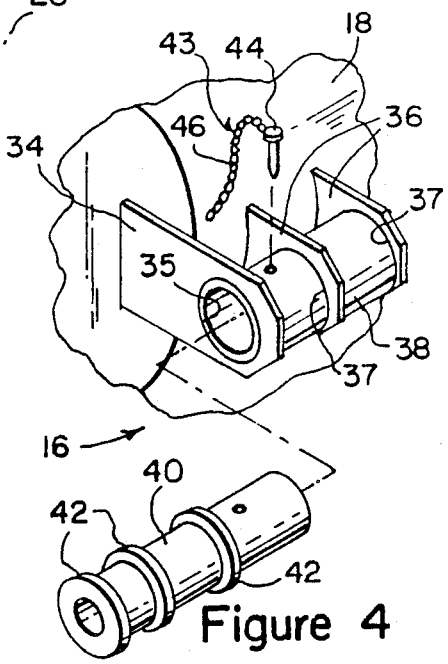
FIG. 4 is a partial exploded perspective view of the quick connect pin unit.

As best seen in FIG. 4, each of the quick connect pin units 16 includes a pair of inner plates 36, an outer plate 34, a socket 38, a push pin 40 and three spaced apart stop rings 42. Each inner plate 36 has an aperture 37 therethrough and is perpendicularly affixed spaced apart to the rearward end of the bucket 18 of the payloader 20. The outer plate 34 has an aperture 35 therethrough and a portion of the outer plate 34 is affixed to side of the bucket 18 of the payloader 20 so that the aperture 35 of the outer plate 34 and the apertures 37 of the inner plates 36 are in alignment with each other. The socket 38 extends through the apertures 37 in the inner plates and the outer plate 34 and affixed thereto while the push pin 40 slideably fits within the socket 38. The three spaced apart stop rings 42 are affixed to the push pin 40 near one end and accurately spaced to provide a quick hook-up block member 22 and push pin 40 thereof so that the inner most of stop rings 42 can bear against the outer plate 34.

A device 43 is provided for holding the push pin 40 stationary within the socket 38 and includes a rod 44 that extends transversely through the socket 38 and the push pin 40. A chain 46 has one end affixed to the rod 44 and other end affixed to the rearward end of the bucket 18 of the payloader to prevent loss of the rod 44.

Figure 3:
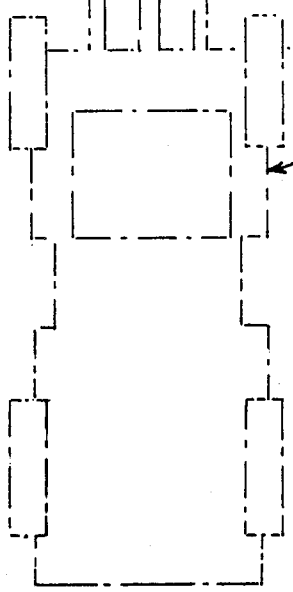
FIG. 3 is a partial exploded perspective view of the quick connect block unit.
Figure 3:
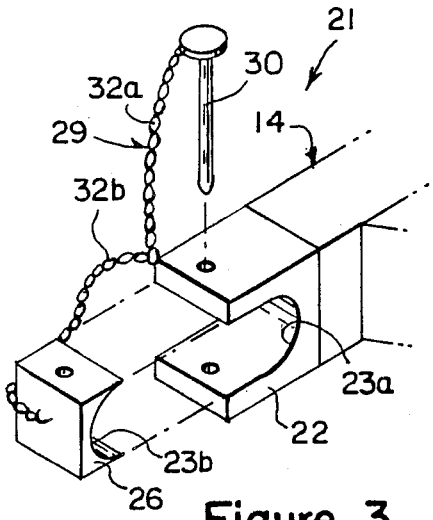

As best seen in FIG. 3, each of the quick connect block units 21 includes a stationary block meber 22 and a reovable block member 26. The stationary block member 22 is generally U-shaped and has half of an aperture **23*a* therethrough while the reovable block member 26 has other half of the aperture 23*b* therethrough. The removable block member 26 fits into the stationary block member 22 thus completing the aperture 23 therethrough so that the push pin 40 can fit at a right angle therein with other two stop rings 42** therebetween.

A device 29 is provided for holding the removable block member 26 stationary within the stationary blcck meber 22 and includes a rod 30 that extends transversely through the stationary block meber 22 and the removable block member 26. A first chain 32*a* has one end affixed to the rod 30 and other end affixed to the stationary block member 22 to prevent loss of the rod 30. A second chain 32*b* has one end affixed to the stationary block member 22 and other end affixed to the the removable block member 26 to prevent loss of the removable block member 26.

Figure 6:
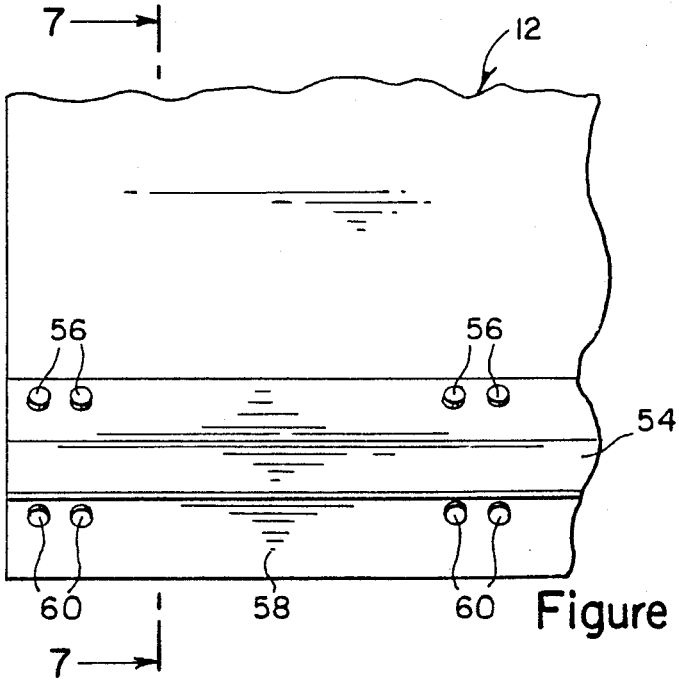
FIG. 6 is a front view with parts broken away of the blade with a replaceable wearing trailing edge member attached thereto.
Figure 7:
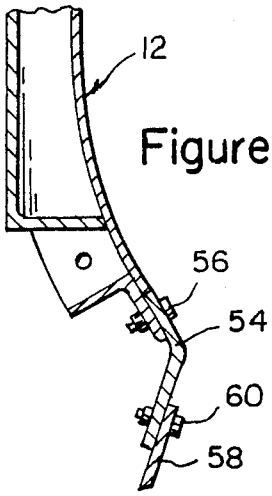
FIG. 7 is a cross sectional view taken along line 7—7 in FIG. 6.
Figure 8:
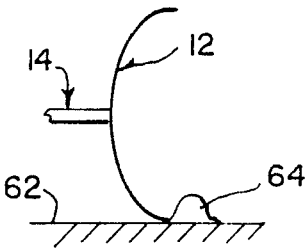
FIG. 8 is a diagramatic side view of the blade without the replaceable wearing trailing edge member engaging and being stopped by an obstruction on the ground.
Figure 8A:
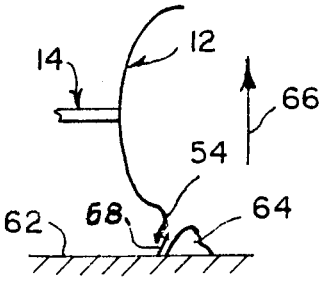
FIG. 8A is a diagramatic side view of the blade with the replaceable wearing trailing edge meber engaging the obstruction.
Figure 8B:
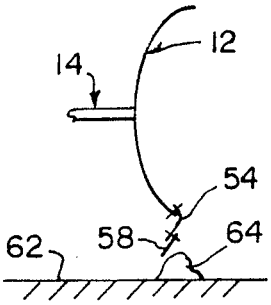
FIG. 8B is a diagrammatic side view silar to FIG. 8A with the replaceable wearing trailing edge member riding up and over the obstruction.

FIGS. 6 and 7 further show an elongated bent adapter edge member 54 mounted by fasteners 56 along lower edge of the snowplow blade 12. An elongated replaceable wearing trailing edge member 58 is mounted by fasteners 60 along lower edge of the elongated bent adapter edge member 54 so that when the snowplow blade 12 encounters an obstruction 64 in the ground 62 the replaceable wearing trailing edge member 58 can ride up and over the obstruction (see FIGS. 8, 8A and 8B).

Figure 5:
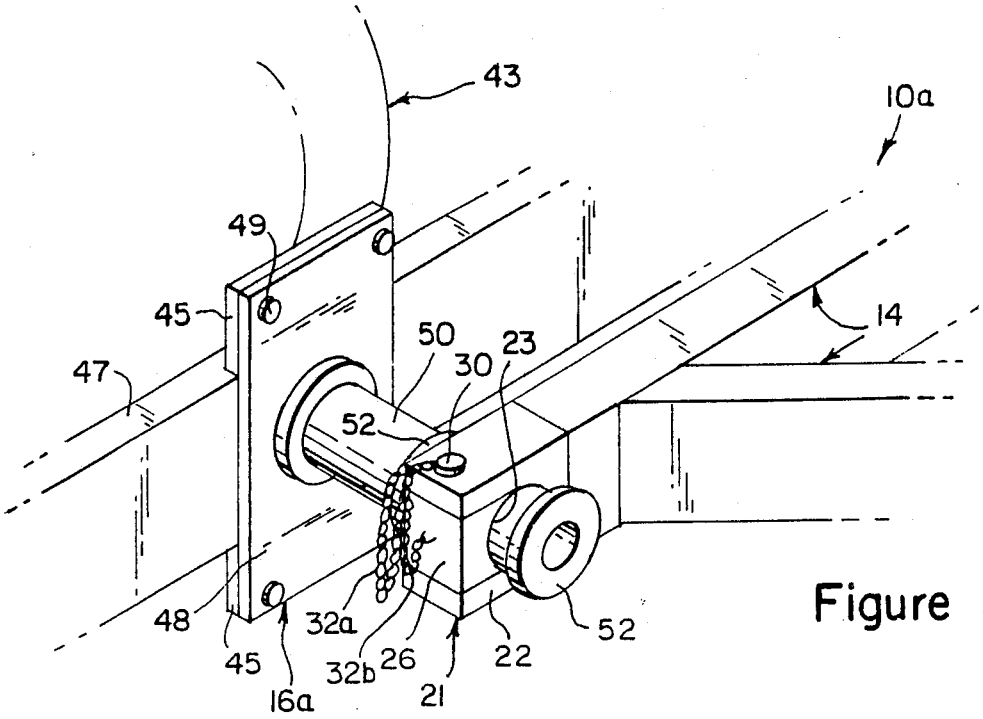

FIG. 5 shows a snowplow assembly 10*a* for a rubber tire dozer 43 having a pair of machine push arms 47 (only one shown in drawing). The snowplow assembly is similar to assebly 10 except for the quick connect pin units 16*a*, which are secured to one side of the push arms 47 of the dozer 43. The snowplow blade 12 (not shown in FIG. 5) can extend in front of the rubber tire dozer 43 with an increased surface for fast removal of snow from the ground 62.

Each of the quick connect pin units 16*a* includes a pair of arm plates 45, a mounting plate 48, a pin 50 and two spaced apart stop rings 52, one of the arm plates 45 is mounted along bottom edge by welding to top edge of the machine push arm 47 while other of the arm plates 45 is mounted along top edge to bottom edge of the machine push arm 47. The mounting plate 48 is secured to the arm plates 45 by fasteners 49. The pin 50 is affixed to center of the mounting plate 48 and extends outwardly therefrom while the two spaced apart stop rings 52 are affixed to the pin 50. In all other respects the assebly 10*a* is like assembly 10.

It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the at without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims

1. A snowplow assembly for a payloader of the type having a bucket, said snowplow assembly comrises:

(a) a pair of quick connect pin units, each of said pin units is secured to one rearward end of the bucket of the payloader;

(b) a pair of quick connect block units, each of said block units is removably clamped onto one of said quick connect pin units;

(c) a pair of push arm frame units, each of said frae units is secured to one of said block units; and (d) an elongated snowplow blade affixed to both of said push arm frame units so that said snowplow blade can extend in front of the bucket of the payloader with an increased surface for fast removal of snow from the ground.

2. A snowplow assembly as recited in claim 1, wherein each of said quick connect pin units includes:

(a) a pair of inner plates, each having an aperture therethrough and perpendicularly affixed spaced apart to the rearward end of the bucket of the payloader;

(b) an outer plate having an aperture therethrough and a portion of said outer plate affixed to side of the bucket of the payloader so that the aperture of said outer plate and the apertures of said inner plates are in alignment with each other;

(c) a socket extending through the apertures in said inner plates and said outer plate and affixed thereto;

(d) a push pin to slideably fit within said socket;

(e) three spaced apart stop rings affixed to said push pin near one end thereof so that inner of said stop rings can bear against said outer plate; and (f) means for holding said push pin stationary within said socket.

3. A snowplow assembly as recited in claim 2, wherein said push pin holding means includes:

(a) a rod that extends transversely through said socket and said push pin; and (b) a chain having one end affixed to said rod and other end affixed to the rearward end of the bucket of the payloader to prevent loss of said rod.

4. A snowplow assembly as recited in claim 3, wherein each of said quick connect block units includes:

(a) a stationary block member being generally U-shaped and having half of an aperture fored therethrough;

(b) a removable block member having other half of the aperture therethrough, said removable block member fits into said stationary block member thus completing the aperture therethrough so that said push pin can fit at a right angle therein with other two stop rings therebetween; and (c) means for holding said removable block member stationary within said stationary block member.

5. A snowplow assembly as recited in claim 4, wherein said removable block member holding means includes:

(a) a rod that extends transversely through said stationary block member and said removable block member;

(b) a first chain having one end affixed to said rod and other end affixed to said stationary block member to prevent loss of said rod; and (c) a second chain having one end affixed to said stationary block member and other end affixed to said reovable block member to prevent loss of said removable block member.

6. A snowplow assembly as recited in claim 5, further comprising:

(a) an elongated bent adapter edge member mounted along a lower edge of said snowplow blade; and (b) an elongated replaceable wearing trailing edge member mounted along said lower edge of said elongated bent adapter edge member so that when said snowplow blade encounters an obstruction in the ground said replaceable wearing trailing edge member can ride up and over the obstruction.

7. A snowplow assebly for a rubber tire dozer of the type having a pair of machine push arms, said snowplow assembly comprises:

(a) a pair of quick connect pin units, each of said pin units is secured to one side of each push arm of the dozer;

(b) a pair of quick connect block units, each of said block units is removably clamped onto one of said quick connect pin units;

(c) a pair of push arm frame units, each of said frame units is secured to one of said block units; and (d) an elongated snowplow blade affixed to both of said push arm frame units so that said snowplow blade can extend in front of the rubber tire dozer with an increased surface for fast removal of snow from the ground.

8. A snowplow assembly as recitd in claim 7, wherein each of said quick connect pin units includes:

(a) a pair of arm plates, one of said arm plates is mounted along a bottom edge to top edge of the machine push arm while other of said arm plates is mounted along said top edge to bottom edge of the machine push arm;

(b) a mounting plate secured to said arm plates;

(c) a pin affixed to the center of said mounting plate to extend outwardly therefrom; and (d) two spaced apart stop rings affixed to said pin.

9. A snowplow assembly as recited in claim 8, wherein each of said quick connect block unit includes:

(a) a stationary block member being generally U-shaped and having half of an aperture formed therethrough;

(b) a removable block member having the other half of the aperture therethrough, said removable block member fits into said stationary block member thus completing the aperture therethrough so that said pin can fit at a right angle therein with said two stop rings therebetween; and c) means for holding said reovable block member stationary within said stationary block member.

10. A snowplow assembly as recited in claim 9, wherein said reovable block meber holding means includes:

(a) a rod that extends transversely through said stationary block member and said removable block member;

(b) a first chain having one end affixed to said rod and other end affixed to said stationary block member to prevent loss of said rod; and (c) a second chain having one end affixed to said stationary block member and the other end affixed to said removable block member to prevent loss of said removable block member.

* * * * *